US009338572B2

(12) United States Patent
Corteel et al.

(10) Patent No.: US 9,338,572 B2
(45) Date of Patent: May 10, 2016

(54) METHOD FOR PRACTICAL IMPLEMENTATION OF SOUND FIELD REPRODUCTION BASED ON SURFACE INTEGRALS IN THREE DIMENSIONS

(71) Applicants: Etienne Corteel, Malakoff (FR); Nguyen Khoa-Van, Paris (FR); Matthias Rosenthal, Dielsdorf (CH)

(72) Inventors: Etienne Corteel, Malakoff (FR); Nguyen Khoa-Van, Paris (FR); Matthias Rosenthal, Dielsdorf (CH)

( * ) Notice: Subject to any disclaimer, the term of this patent is extended or adjusted under 35 U.S.C. 154(b) by 78 days.

(21) Appl. No.: 14/357,588

(22) PCT Filed: Nov. 7, 2012

(86) PCT No.: PCT/EP2012/072033

§ 371 (c)(1),
(2) Date: May 12, 2014

(87) PCT Pub. No.: WO2013/068402

PCT Pub. Date: May 16, 2013

(65) Prior Publication Data

US 2014/0321679 A1 Oct. 30, 2014

(30) Foreign Application Priority Data

Nov. 10, 2011 (EP) ..... 11188537

(51) Int. Cl.

| | |
|---|---|
| ***H04R 5/02*** | (2006.01) |
| ***H04S 1/00*** | (2006.01) |
| ***H04S 7/00*** | (2006.01) |

(52) U.S. Cl.

CPC . *H04S 1/007* (2013.01); *H04S 7/30* (2013.01); *H04S 2420/13* (2013.01)

(58) Field of Classification Search

CPC ..... H04R 5/02; H04S 3/00
USPC ..... 381/300
See application file for complete search history.

(56) References Cited

U.S. PATENT DOCUMENTS

| | | | | |
|---|---|---|---|---|
| 2004/0131338 | A1* | 7/2004 | Asada | H04R 3/12 386/239 |
| 2006/0045275 | A1* | 3/2006 | Daniel | G10H 1/0091 381/17 |
| 2007/0110268 | A1* | 5/2007 | Konagai | H04R 3/12 381/335 |
| 2010/0296678 | A1* | 11/2010 | Kuhn-Rahloff | H04S 7/30 381/303 |

FOREIGN PATENT DOCUMENTS

| | | | |
|---|---|---|---|
| EP | 2056627 | A1 | 5/2009 |

* cited by examiner

*Primary Examiner* — Simon King
(74) *Attorney, Agent, or Firm* — Edwin D. Schindler

(57) ABSTRACT

A method for 3D sound field reproduction from a first audio input signal using a plurality of loudspeakers distributed over a loudspeaker surface aiming at synthesizing a 3D sound field within a listening area in which none of the loudspeakers are located with the sound field radiating from a virtual source, includes the steps of calculating positioning filters using virtual source description data and loudspeaker description data according to a sound field reproduction technique derived from a surface integral, applying positioning filter coefficients to filter the first audio input signal to form second audio input signals. Loudspeakers are positioned for a sampling of the loudspeaker surface into second loudspeaker surfaces for which the loudspeaker spacing is smaller for loudspeakers located in the horizontal plane than for elevated loudspeakers.

5 Claims, 3 Drawing Sheets

Figure 1:
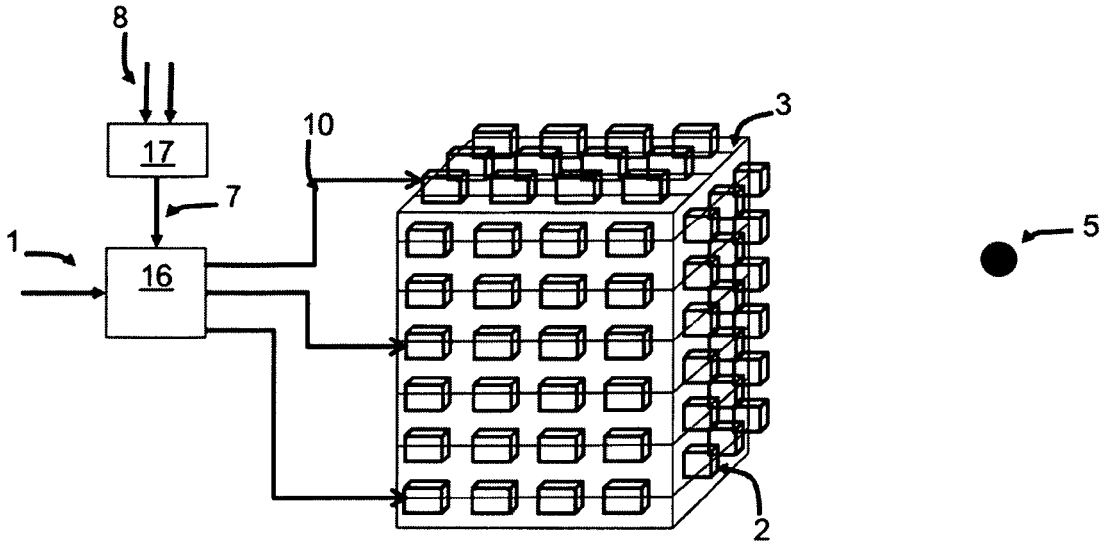

METHOD FOR PRACTICAL IMPLEMENTATION OF SOUND FIELD REPRODUCTION BASED ON SURFACE INTEGRALS IN THREE DIMENSIONS

The invention relates to a method for 3D sound field reproduction from a first audio input signal using a plurality of loudspeakers aiming at synthesizing a 3D sound field within a listening area in which none of the loudspeakers are located, said sound field described as emanating from a virtual source possibly located at elevated positions, said method comprising steps of calculating positioning filters using virtual source description data and loudspeaker description data according to a sound field reproduction technique which is derived from a surface integral, and apply positioning filter coefficients to filter the first audio input signal to form second audio input signals. Said second audio input signals are then modified by loudspeaker weighting data to form third audio input signal. The loudspeaker weighting data depend on horizontal versus vertical sampling, the ratio between each loudspeaker surfaces and the total surface covered by the loudspeakers, and the desired accuracy of the virtual source.

DESCRIPTION OF STATE OF THE ART

Sound field reproduction techniques consist in synthesizing the physical properties of an acoustic wave field through a set of loudspeakers within an extended listening area. The extended listening area is the main advantage of sound field reproduction with respect to current consumer standards such as stereophony or 5.1 systems.

Indeed, the well-known drawback of stereophony is the so-called "sweet spot". It is linked to the listener position with respect to the loudspeakers setup. In the case of stereophony, a sound source may be equally played on through a pair of loudspeakers. The sound image is spatially perceived in the middle of the loudspeakers only if the listener is located at equidistance from the loudspeakers. This illusion is referred to as phantom source imaging. If the listener is out of the equidistant line from loudspeakers, the sound source is perceived closer from the closest loudspeaker. The sound illusion collapses.

Stereophony and phantom source imaging has been widely used for years now. Panning laws have been empirically defined so as to position a virtual source at a given angle from the listener. But it was assumed that the listener is located at equidistance from the loudspeakers.

The same limitations exist with techniques using the stereophonic principles with more loudspeakers such as 5.1, 7.1 and Vector Based Amplitude Panning as disclosed by V. Pulkki in "Virtual sound source positioning using vector based amplitude panning", Journal of the Audio Engineering Society, 45(6), June 1997. The listener's position constraints are even stronger since the sweet spot is exactly located at the center of the loudspeakers' setup.

It can be added that another spatialization technique through loudspeakers' setup exists. The so-called transaural technique consists in delivering binaural signals to the ears using loudspeakers. The binaural signals should be exactly the same signals than the binaural signals a listener would receive at the eardrums with a real sound source at a given position in space. The binaural signals contain all the spatial information, including the acoustic transformations generated by the listener's ears, head and torso, usually referred to as Head Related Transfer Functions. Transaural technique undergoes the same sweet spot constraint as it depends on the relative position between the loudspeakers and the listener as disclosed by T. Takeuchi, P. A. Nelson, and H. Hamada in "Robustness to head misalignment of virtual sound imaging systems", J. Acoust. Soc. Am. 109 (3), March 2001.

Sound field reproduction techniques overcome the sweet spot limitation. They ensure an exact sound field reproduction over an extended listening area. Contrary to the above-mentioned techniques that are listener-oriented, sound field reproduction techniques are source-oriented. In other words, sound field reproduction techniques focus on synthesizing the target sound field. It does not make any assumption about the listener position.

Before being reproduced, the target sound field should be described. There exist three main categories for such description:

an object-based description,
a wave-based description,
and a surface description.

The object-based description considers the target sound field as an ensemble of sound sources. Each source is defined by its position with respect to a reference position and its radiation patterns. Then, the sound field can be calculated at any point of the space.

In the wave-based description, the target sound field is decomposed on a set of basic spatial functions, so called "spatially independent wave components". This allows providing a unique and compact representation of the spatial characteristics of the target sound field. The latter being expressed as a linear combination of the spatially independent wave components (spatial Eigen functions). The spatial basis functions depend on the used system coordinate and mathematical basis. These are usually:

the cylindral harmonics for polar coordinates,
the spherical harmonics for spherical coordinates,
and the plane waves for Cartesian coordinates.

In theory, an exact wave-based description of the target sound field requires an infinite number of spatially independent wave components. In practice, the description has to be truncated to a limited number (or so-called "order"). This description thus only remains valid in a reduced portion of space which size depends on frequency as disclosed for spherical harmonics by J. Daniel in "Représentation de champs acoustiques, application à la transmission et à la reproduction de scènes sonores complexes dans un contexte multimedia" PhD thesis, université Paris 6, 2000.

Finally, the surface description consists in a continuous description of the pressure and/or the normal component of the pressure gradient of the target sound field on the surface of a subspace V. The target sound field can then be calculated in the subspace V using the so-called surface integrals Rayleigh 1 & 2 and Kirchhoff-Helmholtz.

We should add that the three formulations are linked together. It is possible to transpose a given formulation into another. For instance, the object-based description can be turned into the surface description by extrapolating the sound field radiated by the acoustical sources at the boundaries of a subspace V. The extrapolated may be further decomposed into spatial Eigen functions leading to one of the wave-based description.

So far, the sound field description was just under considerations. The next step is the reproduction or the synthesis of the target sound field. Reproduction can also be shared into two categories that are similar to the description step:

Reproduction based on spatial Eigen functions,
Reproduction of pressure (and/or possibly pressure gradient) on the boundary surface enclosing a reproduction subspace.

A first example of spatial Eigen functions reproduction has been implemented with the technology High Order Ambisonic (HOA). This technique targets the reproduction of spherical (or cylindrical) harmonics so as to reproduce a sound field decomposed into spherical harmonics, as disclosed by J. Daniel in "Spatial sound encoding including near field effect: Introducing distance coding filters and a viable, new ambisonic format". Proceedings of the 23th International Conference of the Audio Engineering Society, Helsingør, Denmark, June 2003. A second example of spatial Eigen functions reproduction is given for the plane wave decomposition as disclosed by J. Ahrens and S. Spors in "Sound field reproduction using planar sound field reproduction using planar and linear arrays of loudspeakers", IEEE Transactions on Audio, Speech, and Language Processing, vol. 18(8) pp. 2038-2050, November 2010.

The second sound field reproduction category relies on the reproduction of pressure (and possibly pressure gradient) on the boundary surface of a reproduction subspace. This type of reproduction relies the Kirchhoff Helmholtz integral and its derivatives Rayleigh 1 and 2 as disclosed for Wave Field Synthesis by A. J. Berkhout, D. de Vries, and P. Vogel. In "Acoustic control by wave field synthesis", Journal of the Acoustical Society of America, 93:2764-2778, 1993; and Boundary Sound Control as disclosed by S. Ise in "A principle of sound field control based on the Kirchhof-helmholtz integral equation and the theory of inverse system" ACUSTICA, 85:78-87, 1999.

In the following, WFS will be mostly investigated. WFS is derived from the Kirchhoff Helmholtz integral that is given by the following equation:

$$P(x,\omega) = -\oint_{\partial V} P(x_0,\omega)\frac{\partial G(x \mid x_0,\omega)}{\partial n} - G(x \mid x_0,\omega)\frac{\partial P(x_0,\omega)}{\partial n} dS_0.$$

$P(x,\omega)$ is the sound pressure at the position x and the pulsation $\omega$, $\partial V$ is the closed surface which encompasses the reproduction subspace V. This equality is valid only if all sources that are generating the original sound pressure P are located outside of V and if the position x is comprised in V. The function G is the Green's function that is expressed in 3 dimensional spaces as:

$$G(x \mid x_0,\omega) = \frac{e^{-j\frac{\omega}{c}|x-x_0|}}{4\pi|x-x_0|}.$$

This function describes the radiation of secondary omnidirectional source located at the position $x_0$ and expressed at the position x.

In other words, it means that a primary sound field can be synthesized by a continuous distribution of secondary sources located on the boundary of the volume V enclosing the listening area.

In this original expression, the secondary source distribution is composed of ideal omnidirectional sources (monopoles) and ideal bi-directional sources (dipoles).

However, this formulation cannot be used in practice. Among all, the continuous formulation is impossible to achieve. That's why for reproduction in the horizontal plane only, the WFS, referred to as 2½ D WFS, uses a modified version of the Kirchhoff-Helmholtz integral. It relies on the following approximations:

Approximation 1: The incoming sound field is modeled as emitted by a primary source located at a defined position $x_s$ (model-based description), Approximation 2: The 2½D WFS requires omnidirectional secondary source only along with source selection criterion, Approximation 3: The loudspeaker surface is reduced to a loudspeaker line, Approximation 4: Sampling of the continuous distribution to a finite number of aligned loudspeakers.

These approximations introduce inaccuracies in the synthesized sound field as compared to the target sound field. The reduction of the secondary source surface to a linear distribution in the horizontal plane constraints the possible virtual sources to the horizontal plane (2D reproduction). It also modifies the level of the sound field compared to the target. The limited size and number of loudspeakers also introduces diffraction artifacts that can be reduced by tapering loudspeakers located at the extremities of the array. The spatial sampling limits the exact reproduction of the target sound field to a given upper frequency, the Nyquist frequency of the spatial sampling process, often referred to as "spatial aliasing frequency". It introduces inaccuracies in the localization and audible coloration artifacts as disclosed by H. Wittek in "Perceptual differences between wave field synthesis and stereophony" PhD thesis, University of Surrey, 2007.

These practical limitations have been addressed in the state of the art. A method for compensating for the loudspeaker directivity and controlling the sound field over a given area is disclosed by E. Corteel in "Equalization in extended area using multichannel inversion and wave field synthesis," Journal of the Audio Engineering Society, vol. 54, no. 12, 2006. A solution is proposed in EP2206365 so as to increase the spatial aliasing frequency by defining a preferred listening area in which the sound field should be reproduced with best accuracy.

Finally, the current state of the art for 2½ D WFS proposes practical and affordable solutions for the sound field reproduction in the horizontal plane.

Formulation of 3D WFS

The formulation of 3D WFS for continuous surfaces only is disclosed by S. Spors, R. Rabenstein, and J. Ahrens in "The theory of wave field synthesis revisited", 124th conference of the Audio Engineering Society, 2008; and M. Naoe, T. Kimura, Y. Yamakata, and M. Katsumoto, in "Performance evaluation of 3d sound field reproduction system using a few loudspeakers and wave field synthesis", 2nd International Symposium on Universal Communication, 2008.

The 3D WFS formulation is based on a simplification of the Kirchhoff-Helmholtz integral, considering a continuous surface distribution of omnidirectional secondary sources only:

$$P(x,\omega) \approx -\oint_{\partial V} a(x_s, x_0)\frac{\partial P(x_0,\omega)}{\partial n} G(x \mid x_0,\omega) dS_0,$$

where:

$$a(x_s, x_0) = \begin{cases} 1 & \text{if } \langle x_0 - x_s, n(x_0)\rangle > 0 \\ 0 & \text{otherwise} \end{cases},$$

and G is the 3D Green's function.

The loudspeakers' driving function is thus expressed by $$D_{wfs3d,cont}(x_0, x_s, \omega) = -2a(x_s, x_0)\frac{(x_0 - x_s)^T n(x_0)}{4\pi|x - x_0|^2}\left(\frac{1}{|x - x_0|} + \frac{j\omega}{c}\right)e^{-j\frac{\omega}{c}|x_s - x_0|}S(\omega),$$

where $S(\omega)$ is the alimentation signal of the virtual source expressed in the frequency domain.

This formulation assumes that the primary sound field is emitted by a virtual point source having omnidirectional radiation characteristics. The window function $a(x_s, x_0)$ operates a secondary source selection among the continuous distribution of secondary omnidirectional sources.

The 3D WFS formulation does not make any difference between horizontal or vertical secondary source distributions.

However, as disclosed by J. Blauert in "Spatial Hearing, The Psychophysics of Human Sound Localization", MIT Press, 1999, the auditory human perception in three dimensions is limited: the localization of sound events is not as precise in elevation as in azimuth.

Finally, the current formulation of 3D WFS is theoretical. It does not face any practical constraints as the 2½ D WFS does. The main drawback of the state of the art is there are no sampling strategies. The implementation of the continuous formulation is impossible.

Another drawback of the state of the art deals with the number of loudspeakers. The current spatial sampling criterion for 2½ D WFS would require a squared number of loudspeakers. Switching to 3D WFS with such a criterion would thus require an impractical number of loudspeakers.

The current state of the art does not take into account the human perception. The continuous formulation of 3D WFS equally considers azimuth and elevation. On the contrary, the auditory localization is better in the horizontal plane than in the vertical plane.

Another drawback of the current formulation is that the effective size of listening area is not taken into account. The loudspeaker driving functions are computed to fit the volume surrounded by the loudspeaker surface.

Aim of the Invention

The aim of the invention is to provide means to reproduce the sound field in three dimensions with a finite set of loudspeakers enclosing a listening area. It is another aim of the invention to define sampling strategies that take into account the limitations of human auditory perception in height. It is another aim of the invention to reduce the required number of loudspeakers for limiting cost and time required for processing the virtual sources. It is another aim of the invention to define loudspeaker driving functions based on the above mentioned aims so as to obtain the best sound field reproduction possible in a preferred listening area. In other words, the aim of the invention is to give practical solutions to the implementation of the 3D WFS formulation.

SUMMARY OF THE INVENTION

The invention consists in a method for efficient sound field control in 3 dimensions over an extended listening area using a plurality of loudspeakers located in the horizontal plane as well as in elevation.

The method presented here involves defining a loudspeaker surface with affordable loudspeaker positioning in practice, depending on the target application. The surface may be closed or not depending on the practical installation.

A first step of the method consists in defining the position of the individual loudspeakers on the surface. It is proposed that the loudspeaker distribution located in a reference horizontal plane should be substantially denser than loudspeakers located at elevated positions.

A second step of the method consists in sampling the whole loudspeaker surface into second loudspeaker surfaces related to each individual loudspeaker. The third step of the method is to define loudspeaker weighting data related to the ratio between the area $S_i$ of each second loudspeaker surface and the total area S of the loudspeaker surface.

Loudspeaker driving functions are finally obtained from the continuous 3D WFS driving function as:

$$D_{wfs3d,i}(x_s, \omega) = G_i F_i(\omega) D_{wfs3d,cont}(x_i, x_s, \omega).$$

Correction gains $G_i$ are related to the loudspeaker weighting data to take into account the different areas that individual loudspeakers are associated to. Correction gains $G_i$ are typically lower for lower loudspeaker weighting data. Similarly the correction filter $F_i(\omega)$ is defined to compensate for sampling errors that occur above the spatial aliasing frequency caused by the sampling of the loudspeaker surface $\partial V$. Similar compensation filters are described in the case of 2½ D WFS by Spors and Ahrens in "Analysis and improvement of pre-equalization in 2.5-dimensional wave field synthesis", 128th conference of the Audio Engineering Society, 2010.

The driving functions can be further simplified by assuming that the virtual sources are located in the far field of the loudspeakers:

$$\hat{D}_{wfs3d,i}(x_s, \omega) = -2a(x_s, x_i)\frac{(x_i - x_s)^T n(x_i)}{|x - x_i|}\frac{e^{-j\frac{\omega}{c}|x_s - x_0|}}{4\pi|x - x_i|}G_i F_i(\omega)\left(\frac{j\omega}{c}\right)S(\omega).$$

It should be noted that this far field assumption can be realized considering frequencies high enough for a given virtual source position or virtual sources sufficient distant from any loudspeaker at a given frequency.

More complex source models may also be applied:

$$\hat{D}_{wfs3d,i}(x_s, \omega) = -2a(x_s, x_i)\frac{(x_i - x_s)^T n(x_i)}{|x - x_i|}\frac{e^{-j\frac{\omega}{c}|x_s - x_0|}}{4\pi|x - x_i|}G_i F_i(\omega)C(x_s, x_i, \omega)S(\omega),$$

where $C(x_s, x_i, \omega)$ is a function that describes the directivity characteristics of the virtual source. As disclosed in the case of 2½ D WFS by E. Corteel in "Synthesis of directional sources using wave field synthesis, possibilities and limitations" EURASIP Journal on Applied Signal Processing, special issue on Spatial Sound and Virtual Acoustics, 2007, this directivity function may be decomposed into spherical or cylindrical harmonics up to a certain order to provide a compact description of the directivity function that can be easily adapted (rotated) depending on the orientation of the virtual sound source.

Additionally, the loudspeaker weighting data may also be computed in order to improve the sound field rendering into a preferred listening area as described in EP2206365 for 2½ D WFS. In this case the loudspeaker weighting data are calculated from the ratio between the area $S_i$ of each second loudspeaker surface and the total area S of the loudspeaker surface but also based on description data of the preferred listening area and the primary source. For simplicity, the procedure may only consider the virtual source description data and the loudspeaker description data by referencing their positions towards a reference listening position comprised in the preferred listening area. This reference position is thus considered at the origin of the coordinate system.

Loudspeaker weighting data are lower for loudspeakers located at bigger distances from the line joining the primary source location and a reference position in the preferred listening area. As explained by Corteel et al. in "Wave field synthesis with increased aliasing frequency", in 124th conference of the Audio Engineering Society, 2008, this processing enables to increase the spatial aliasing frequency and therefore reducing the amount of perceptual artifacts for 2½ D WFS into the preferred listening area.

This procedure tends to amplify the loudspeaker weighting data for loudspeakers located around the direction of the virtual sound source. As disclosed by E. Corteel, L. Rohr, X. Falourd, K-V. Nguyen and H. Lissek in "A practical formulation of 3 dimensional sound reproduction using Wave Field Synthesis", 1st International Conference on Spatial Audio, November 2011, Detmold, Germany, such a procedure can improve sound localization precision for elevation sources using 3D WFS.

The use of a non-closed surface can be related to a classical approximation performed in 2½ D WFS where an incomplete loudspeaker array is often used. A typical example is the use of a unique horizontal line array that is a reduction of an infinite line array. The consequences of such an approximation are analyzed in details by E. Corteel in "Caractérisation et extensions de la Wave Field Synthesis en conditions réelles", Université Paris 6, PhD thesis, Paris, 2004.

The first consequence is the limitation of the virtual source positioning possibilities so that it remains visible within an extended listening area through the opening of the loudspeaker array. Such simple geometric criterion can be readily extended to 3D so as to define the subspace in which virtual sources can be located such that they are visible within a listening subspace through the loudspeaker surface.

The second consequence is that the defined finite size opening creates diffraction artifacts at low frequencies. However, it should be noticed that such artifacts already exist in continuous 3D WFS. They are caused by the window function $a(x_s, x_i)$ that allows using omnidirectional secondary sources only for the reproduction of a given virtual source. This window function operates a spatial secondary source selection that also introduces diffraction artifacts. A classical solution for the reduction of diffraction artifacts is to apply tapering (reduction of level at the extremities of the window). Such level reduction may be obtained using a small reduction of the correction gains $G_i$ for loudspeakers located at the extremities of the window.

The use of a limited number of loudspeakers at elevated positions may be justified by analyzing the contributions of each loudspeaker for the synthesis of a given sound source. The driving functions $D_{wfs3d,i}(x_s, \omega)$ are mostly composed of a gain, a delay, and a filter. The gain value has contributions related to the spatial sampling of the loudspeaker surface, which are mostly independent of the virtual source position, and related to the normal gradient of the pressure radiated by the virtual source expressed at the loudspeaker position. The latter can be expressed in a simple form as:

$$\frac{1}{4\pi|x - x_i|} \times \frac{(x_i - x_s)^T n(x_i)}{|x - x_i|}$$

The first part can be directly related to the attenuation of the radiated sound field at the position of the loudspeaker. The second part relates to the normalized scalar product between the vector joining the loudspeaker position and the virtual source position with the normal gradient to the surface at the loudspeaker position.

This equation shows that loudspeakers located within the horizontal plane will provide the most significant contribution to the reproduction of a virtual source located also in the horizontal plane for two reasons. First, the loudspeakers are closer to the source and therefore the attenuation of the sound field is lower for these loudspeakers. Second, for relatively smooth surface shapes, the normal gradient to the surface will also point more towards sources located in the vicinity (i.e. the horizontal plane) rather than for sources located in the elevation.

Therefore, the use of denser loudspeaker distributions in the horizontal plane enables to focus on a more precise rendering of sources located in the horizontal plane where localization is most accurate. These are the loudspeakers that will receive the most significant part of the energy for the synthesis of sources located substantially in the horizontal plane.

The contribution of loudspeakers that are closer to the source can be further enhanced using a windowing functions that concentrates on loudspeakers that are located in the direction of the virtual source.

In other words, there is presented here a method for 3D sound field reproduction from a first audio input signal using a plurality of loudspeakers distributed over a loudspeaker surface aiming at synthesizing a 3D sound field within a listening area in which none of the loudspeakers are located, said sound field being described as being radiated from a virtual source. The method includes steps of calculating positioning filters using virtual source description data and loudspeaker description data according to a sound field reproduction technique derived from a surface integral. The positioning filter coefficients are applied to the first audio input signal to form second audio input signals. Therefore, loudspeakers are positioned so as to realize a sampling of the loudspeaker surface into second loudspeaker surfaces for which the loudspeaker spacing is substantially smaller in the horizontal plane than for elevated loudspeakers. Then the method defines loudspeaker weighting data from the ratio between the area covered by each second loudspeaker surfaces and the total area of the loudspeaker surface. The second audio input signals are modified according to the loudspeaker weighting data in order to form the third audio input signals. Finally, loudspeakers are alimented with the third audio input signals so as to reproduce a 3D sound field.

Furthermore, the method may comprise steps wherein the modification of the second audio input signals implies at least to reduce the level of second audio input signals corresponding to low loudspeaker weighting data. And the method may also comprise steps:

- wherein the level reduction method is also frequency dependent.
- wherein the loudspeaker weighting data are calculated using the ratio between the area covered by second loudspeaker surfaces and the total area of the loudspeaker surface combined with a decreasing function of the distance between each loudspeaker to the line joining the virtual source position according to the virtual source positioning data and the reference listening position located within the listening area.
- wherein the loudspeaker weighting data are calculated using the ratio between the area covered by second loudspeaker surfaces and the total area of the loudspeaker surface combined with a decreasing function of the absolute angle difference between each loudspeaker and the virtual source position according to the virtual source positioning data calculated relative to the reference listening position located within the listening area.

Figure 4:
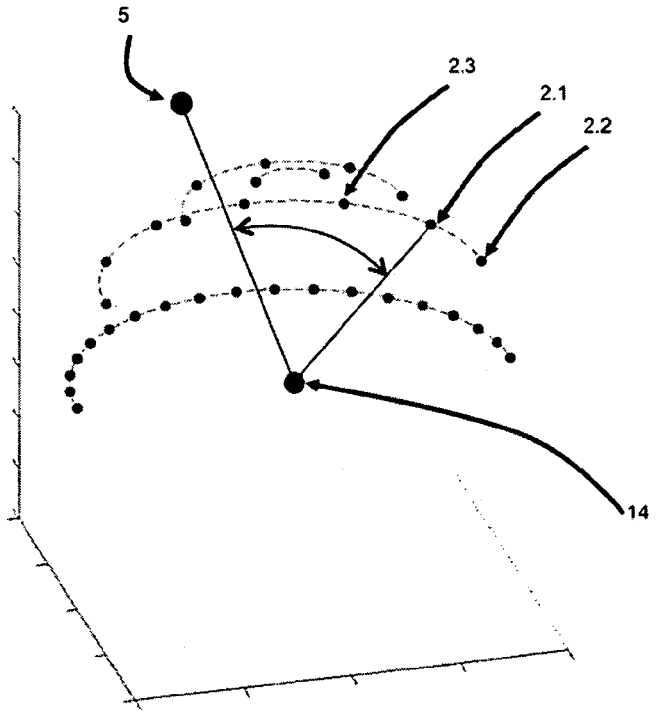
Figure 5:
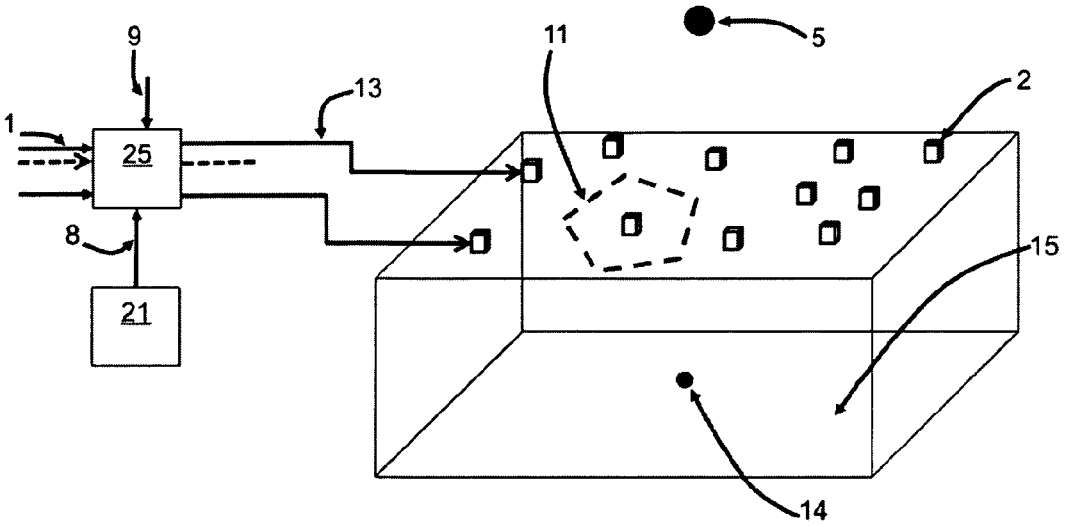
Figure 6:
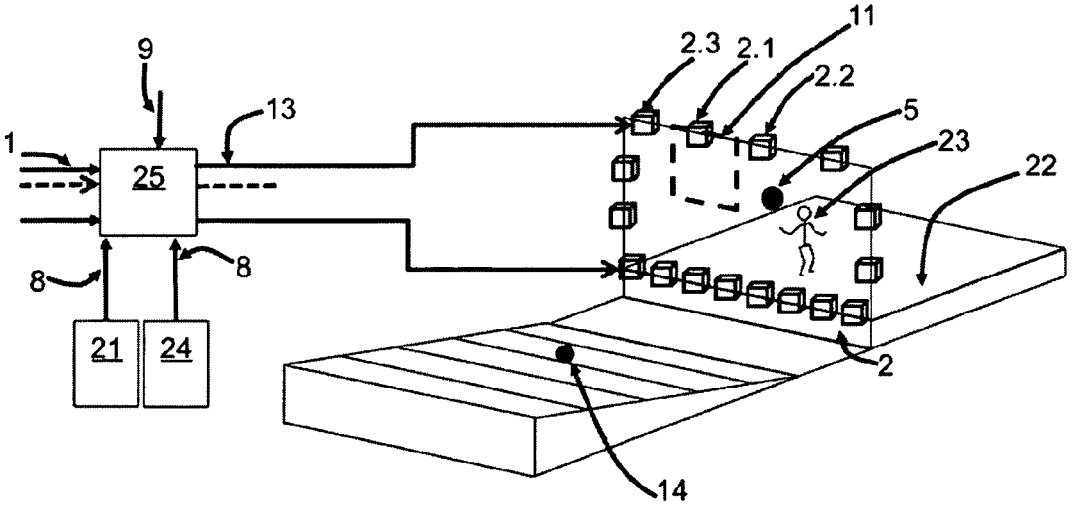

The invention will be described with more detail hereinafter with the aid of examples and with reference to the attached drawings, in which FIG. 1 describes a sound field rendering method according to state of the art FIG. 2 describes a sound field rendering method according to the invention FIG. 3 describes a first embodiment according to the invention FIG. 4 describes a second embodiment according to the invention FIG. 5 describes a third embodiment according to the invention FIG. 6 describes a fourth embodiment according to the invention

DETAILED DESCRIPTION OF FIGURES

FIG. 1 describes a 3D sound field rendering method according to state of the art. According to this method, a sound field filtering device 16 calculates a plurality of second audio signals 10 from a first audio input signal 1, using positioning filters coefficients 7. Said positioning filters coefficients 7 are calculated in a positioning filters computation device 17 from virtual source description data 8 and loudspeaker description data 9. The position of the loudspeakers 2 and the virtual source 5, comprised in the virtual source description data 8 and the loudspeaker description data 9, are defined relative to a reference position 14. The second audio signals 3 drive a plurality of loudspeakers 2 synthesizing a sound field 4. Said method requires in theory a continuous distribution of loudspeakers which can be replaced, until a spatial Nyquist frequency, by a regularly sampling of loudspeakers on a closed loudspeaker surface.

Figure 2:
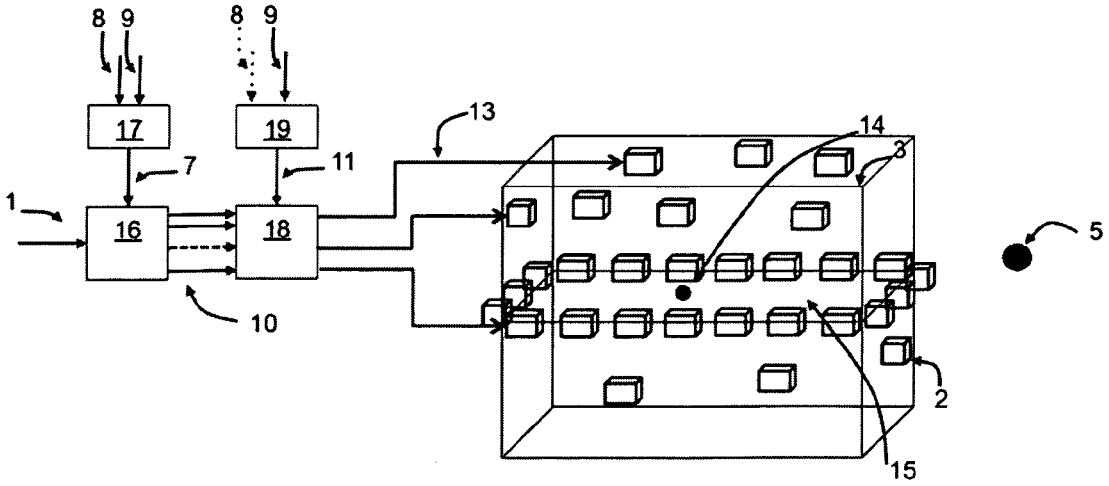

FIG. 2 describes a sound field rendering device method to the invention. According to this method, a sound field filtering device 16 calculates a plurality of second audio signals 10 from a first audio input signal 1, using positioning filters coefficients 7 that are calculated in a positioning filters computation device 17 from virtual source description data 8 and loudspeaker positioning data 9. The position of the loudspeakers 2 and the virtual source 5 (comprised in the virtual source description data 8 and the loudspeaker description data 9) are defined relative to a reference position 14. A spatial sampling adaptation computation device 18 calculates third audio input signals 13 from second audio input signals 3 using loudspeaker weighting data 12 derived from loudspeakers positioning data 9 in a loudspeaker weight computation device 19. In this illustration of the method according to the invention, the loudspeaker array used for sound field reproduction is denser in the horizontal plane 15 where sound localization is most accurate.

Description of Embodiments

In a first embodiment of the invention, a plurality of loudspeakers is mounted on the walls and ceiling of a cinema installation. The listening area should cover every seats of the room. The horizontal sampling is the smallest especially behind the screen so that the virtual sources remain accurate and thus coherent with the images. The horizontal sampling for the sides and rear is sparser than for the front part. The sampling for elevated loudspeakers can be loose since the method makes profits of the lower auditory localization accuracy for elevated sources so as to limit the number of physical loudspeakers required.

Input signals such as voices and dialogs are typically positioned on the center of the screen with an accurate and narrow virtual source. Input signals such as ambience are spread among the rear and above loudspeakers. The virtual sources can also be positioned according to the current audio format such as 5.1 or 7.1. Such setup may also be used to accommodate for upcoming formats containing elevated channels such as 9.1 and up to 22.2. The method allows widening the listening area whereas the current techniques are available on a unique or narrow sweet spot located at the center of the system. When the listener is out of the sweet spot, the perceived sound field is distorted and attracted to the closest loudspeakers.

Figure 3:
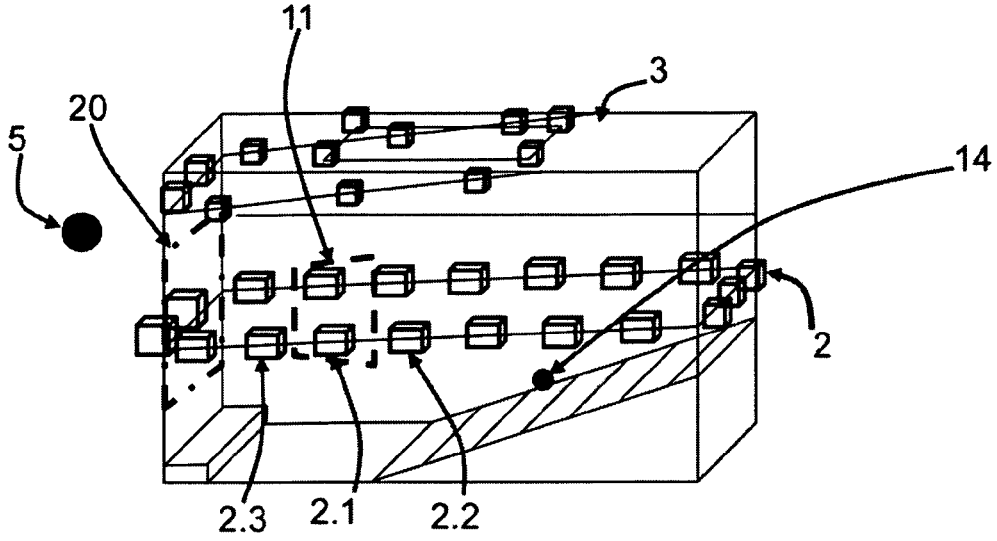

This embodiment is described in FIG. 3 where the loudspeakers 2 are typically located on three identified levels where the first level is located about at the ear level of the audience and closes in the middle of the height of the screen, the second level is located at the upper part of the room, the third level forms a line along the ceiling of the room. Therefore, each level defines a line along which loudspeakers 2 are positioned.

The second loudspeaker surface 11 can thus be defined along each dimension separately (within level, across levels) using the distance to the closest loudspeakers 2.2 and 2.3 on the level where the given loudspeaker 2.1 is located (within level), and using the distance of the given loudspeaker to the closest level (across levels). The defined loudspeaker surfaces have simple shapes which area can be easily calculated to compute the loudspeaker weighting data 12.

In this embodiment, the virtual source description data 8 may comprise the position of the virtual source 5. The coordinate system may be Cartesian, spherical or cylindrical with its origin located at the reference position 14. The virtual source description data 8 may also comprise data describing the radiation characteristics of the virtual source 5, for example using frequency dependant coefficients of a set of spherical harmonics as disclosed by E. G. Williams in "Fourier Acoustics, Sound Radiation and Nearfield Acoustical Holography", Elsevier, Science, 1999. The virtual source description data 8 may also comprise orientation data using vehicle's center of mass system (yaw, pitch, roll angles of rotation) as disclosed in http://en.wikipedia.org/wiki/Flight_dynamics. The loudspeaker description data 9 may comprise the position of the loudspeakers, preferably the same as for the virtual source description data 8. The coordinate system may be Cartesian, spherical or cylindrical with its origin located at the reference position 14. The positioning filter coefficients 7 may be defined using virtual source description data 8 and loudspeaker description data 9 according to 3D Wave Field Synthesis as disclosed by S. Spors, R. Rabenstein, and J. Ahrens in The theory of wave field synthesis revisited, in 124th conference of the Audio Engineering Society, 2008. The resulting filters may be finite impulse response filters. The filtering of the first input signal may be realized using convolution of the first input signal 1 with the positioning filter coefficients 7.

The third audio input signals 13 are obtained by modifying the level of the second audio input signals 3, possibly with frequency dependant attenuation factors, according to an increasing function of the loudspeaker weighting data 12. The attenuation factors may be linearly dependant to the loudspeaker weighting data 12, follow an exponential shape, or simply null below a certain threshold of the loudspeaker weighting data 12.

In a second embodiment of the invention, a plurality of loudspeakers 2 is distributed over a quarter sphere in the upper frontal hemisphere. The spatial sampling is the smallest in the frontal horizontal line, bigger on a second upper horizontal line (constant elevation of 30 degrees away from the horizontal plane), sparse on a third line at 60 degrees elevation. Only a very low number of loudspeakers are used at 80 degrees elevation for closing the above part of the quarter sphere (FIG. 4).

The second loudspeaker surfaces are calculated by defining an angular boundary for each loudspeaker independently along the azimuthal and the elevation direction. The elevation is simply defined by calculating the angular difference between each level. The azimuthal part can be simply defined as the angular difference between the azimuthal position of the current loudspeaker 2 and azimuthal position of the closest loudspeakers on either side of the current loudspeaker 2. The loudspeaker weighting data 12 are thus defined as the ratio of the spanned solid angle defined for each loudspeaker over $\pi$ (solid angle for the quarter sphere).

The loudspeaker weighting data 12 may be further calculated so as to improve the spatial rendering in a preferred listening area 6 around the center of the quarter sphere. The loudspeaker weighting data 12 are then modified depending on the virtual source 5 according to the absolute angular difference between the azimuthal and the elevation position of loudspeaker 2.1 and the virtual source 5 position given in spherical coordinates considering the reference position as the origin of the coordinate system. The loudspeaker weighting data correction is then a decreasing function of the absolute angular difference in both azimuth and elevation.

The method allows positioning a virtual source in front or above the listener. The setup is then used for psychophysical experiment to evaluate human auditory localization performances. It may also be used in conjunction to a screen for investigating audio-visual perception, in behavioral studies involving multi-modal perception, or in an environmental simulation application (architecture/urbanism, car simulation, . . . ).

In a third embodiment of the invention, a plurality of loudspeakers 2 is distributed over the ceiling of a room. Such installation may be realized in a clubbing environment for sound reinforcement, targeting a proper distribution of energy over the entire dance floor and allowing for spatial sound reproduction (cf FIG. 5).

In this embodiment, the loudspeakers 2 may be irregularly spread and positioned where it is practically possible to do so. The second loudspeaker surfaces 11 can be calculated using Voronoi Tesselation as disclosed by Atsuyuki Okabe, Barry Boots, Kokichi Sugihara & Sung Nok Chiu in *Spatial Tessellations—Concepts and Applications of Voronoi Diagrams,* 2nd edition, John Wiley, 2000.

This embodiment may be dedicated to the playback of virtual sources 5 located at elevated positions and large distances that emulate stereophonic reproduction for a large listening area 6. In this embodiment, the first audio input signals 1 may also comprise effect channels that can be freely positioned by the DJ along a large portion of an upper half hemisphere by manipulating the virtual source description data 8 using an interaction device 21 (joystick, touch screen interface, . . . ). The modified virtual source description data 8 are fed into a sound field rendering device according to the invention 25 that modifies the plurality of input audio signals 1 so as to form third audio input signals 13 that aliment the loudspeakers 2 forming the desired sound field 4.

In a fourth embodiment of the invention, the loudspeakers 2 may be positioned at two levels below and above the stage 22 of a theater. This In this case, the loudspeaker spacing may be smaller for loudspeakers 2 placed at the lower level than for loudspeakers 2 placed at the higher level. The virtual sources 5 may be positioned in the space defined by the opening of the stage. In this embodiment, the first audio input signals 1 may be obtained from live sound of actors or musicians 23 on stage 22. The virtual source description data 8 may comprise positioning data defined in a Cartesian or spherical coordinate system and orientation data (yaw, pitch, roll) either entered manually by the sound engineer using an interaction device 21 or obtained automatically using a tracking device 24. The modified virtual source description data 8 are fed into a sound field rendering device according to the invention 25 that modifies the plurality of input audio signals 1 so as to form third audio input signals 13 that aliment the loudspeakers 2, forming the desired sound field 4.

The second loudspeaker surfaces 11 may be described as rectangles spanning half of the height difference between both loudspeaker arrays and expending to half of the distance between two closest loudspeakers 2.2 and 2.3 on either side of the considered loudspeaker 2.1.

Applications of the invention are including but not limited to the following domains: hifi sound reproduction, home theatre, cinema, concert, shows, car sound, museum installation, clubs, interior noise simulation for a vehicle, sound reproduction for Virtual Reality, sound reproduction in the context of perceptual unimodal/crossmodal experiments.

Although the foregoing invention has been described in some detail for the purposes of clarity of understanding, it will be apparent that certain changes and modifications may be practiced within the scope of the appended claims. Accordingly, the present embodiments are to be considered as illustrative and not restrictive, and the invention is not limited to the details given herein, but may be modified with the scope and equivalents of the appended claims.

The invention claimed is:

1. A method for 3D sound field reproduction from a first audio input signal using a plurality of loudspeakers distributed over a loudspeaker surface aiming at synthesizing a 3D sound field within a listening area in which none of the plurality of loudspeakers are located, said sound field being radiated from a virtual source, said method comprising steps of:

calculating positioning filters using virtual source description data and loudspeaker description data according to a sound field reproduction technique derived from a surface integral;

applying positioning filter coefficients for filtering the first audio input signal for forming second audio input signals;

positioning loudspeakers for realizing a sampling and fractioning of the entire loudspeaker surface into second, fractioned and smaller loudspeaker surfaces assigned to each single loudspeaker of the plurality of loudspeakers, and for which fractioned loudspeaker surfaces the loudspeaker spacing is smaller for loudspeakers located in a horizontal plane than for elevated loudspeakers so loudspeaker density in said horizontal plane is the highest and decreases with distances of loudspeakers located away, and thus elevated from, said horizontal plane;

defining loudspeaker weighting data from a ratio between an area covered by the second loudspeaker surfaces and a total area of the loudspeaker surface;

modifying the second audio input signals according to the loudspeaker weighting for forming third audio input signals; and, alimenting loudspeakers with the third audio input signals for synthesizing a sound field.

2. The method of claim 1, wherein modification of the second audio input signals implies a reduction of a level of the second audio input signals corresponding to low loudspeaker weighting data.

3. The method of claim 2, wherein the reduction of the level of the second audio input signals corresponding to low loudspeaker weighting data is frequency dependent.

4. The method of claim 1, wherein the loudspeaker weighting data are calculated using the ratio between the area covered by the second loudspeaker surfaces and the total area of the loudspeaker surface combined with a decreasing function of the distance between each loudspeaker to a line joining the virtual source position according to the virtual source positioning data and a reference listening position located within the listening area.

5. The method of claim 1, wherein the loudspeaker weighting data are calculated using the ratio between the area covered by the second loudspeaker surfaces and the total area of the loudspeaker surface combined with a decreasing function of an absolute angle difference between each loudspeaker and the virtual source position according to the virtual source positioning data calculated relative to a reference listening position located within the listening area.

* * * * *